US010635052B2

(12) United States Patent
Dubois et al.

(10) Patent No.: US 10,635,052 B2
(45) Date of Patent: Apr. 28, 2020

(54) EXTERNAL PART BASED ON PHOTOSTRUCTURABLE GLASS

(71) Applicant: THE SWATCH GROUP RESEARCH AND DEVELOPMENT LTD., Marin (CH)

(72) Inventors: Philippe Dubois, Marin (CH); Thierry Hessler, St-Aubin (CH); Christian Charbon, Chézard-St-Martin (CH)

(73) Assignee: THE SWATCH GROUP RESEARCH AND DEVELOPMENT LTD., Marin (CH)

( * ) Notice: Subject to any disclaimer, the term of this patent is extended or adjusted under 35 U.S.C. 154(b) by 156 days.

(21) Appl. No.: 15/924,768

(22) Filed: Mar. 19, 2018

(65) Prior Publication Data

US 2018/0210402 A1 Jul. 26, 2018

Related U.S. Application Data

(62) Division of application No. 14/729,231, filed on Jun. 3, 2015, now Pat. No. 9,958,835.

(30) Foreign Application Priority Data

Jun. 3, 2014 (EP) ..... 14171016

(51) Int. Cl.

| | |
|---|---|
| ***G04B 39/00*** | (2006.01) |
| ***G04D 3/00*** | (2006.01) |
| ***G04B 37/22*** | (2006.01) |
| ***G04B 19/12*** | (2006.01) |

(52) U.S. Cl.

CPC ..... *G04B 39/002* (2013.01); *G04B 19/12* (2013.01); *G04B 37/22* (2013.01); *G04D 3/00* (2013.01); *Y10T 428/19* (2015.01)

(58) Field of Classification Search

CPC ..... G04B 39/00
USPC ..... 428/57
See application file for complete search history.

(56) References Cited

U.S. PATENT DOCUMENTS

| | | | |
|---|---|---|---|
| 6,710,540 | B1 | 3/2004 | Albert et al. |
| 6,955,975 | B2 | 10/2005 | Reichenbach et al. |
| 7,753,581 | B2 | 7/2010 | Hessler et al. |
| 8,354,032 | B2 | 1/2013 | Dinger et al. |
| 8,486,279 | B2 | 7/2013 | Fiaccabrino et al. |

(Continued)

FOREIGN PATENT DOCUMENTS

| | | |
|---|---|---|
| EP | 1 436 830 A1 | 7/2004 |
| EP | 1 791 039 A1 | 5/2007 |

(Continued)

OTHER PUBLICATIONS

Becker, H., et al. "Chemical analysis in photostructurable glass chips," Sensors and Actuators B 86 (2002) 271-279.

(Continued)

*Primary Examiner* — Brent T O'Hern
(74) *Attorney, Agent, or Firm* — Oblon, McClelland, Maier & Neustadt, L.L.P.

(57) ABSTRACT

The invention relates to an external part including a first portion based on photostructurable glass, at least one second portion based on at least one second material. According to the invention, one surface of the first portion is made integral with a surface of the second portion so as to form a one-piece external part.

10 Claims, 2 Drawing Sheets

(56) References Cited

U.S. PATENT DOCUMENTS

| | | | | |
|---|---|---|---|---|
| 2009/0016173 | A1 | 1/2009 | Hessler et al. | |
| 2010/0005659 | A1 | 1/2010 | Dinger et al. | |
| 2010/0243603 | A1 | 9/2010 | Fiaccabrino et al. | |
| 2013/0234297 | A1* | 9/2013 | Breymesser ..... | H01L 23/3178 257/623 |
| 2013/0279307 | A1 | 10/2013 | Fiaccabrino et al. | |
| 2015/0346686 | A1 | 12/2015 | Dubois | |

FOREIGN PATENT DOCUMENTS

| | | | |
|---|---|---|---|
| EP | 2 060 534 | A1 | 5/2009 |
| EP | 2 145 857 | A1 | 1/2010 |
| WO | WO 03/032377 | A1 | 4/2003 |

OTHER PUBLICATIONS

European Search Report issued in corresponding application 14171016, dated Feb. 23, 2015.

* cited by examiner

EXTERNAL PART BASED ON PHOTOSTRUCTURABLE GLASS

This application is a divisional of and claims the benefit of priority under 35 U.S.C. § 120 from U.S. application Ser. No. 14/729,231, filed on Jun. 3, 2015, which claims the benefit of priority under 35 U.S.C. § 119 from European Patent Application No. 14171016.0, filed on Jun. 3, 2014, the entire contents of each of which is hereby incorporated herein by reference.

FIELD OF THE INVENTION

The invention relates to an external part based on photostructurable glass and particularly an external part of this type including at least one photostructurable glass based portion and at least one other silicon, metal or ceramic based portion.

BACKGROUND OF THE INVENTION

In the field of horology, an increasing number of external parts are formed with the aid of fragile materials such as those based on silicon or ceramic. For example, it is possible to envisage forming the crystal, the bracelet, wristlet or the crown.

However, techniques for etching these fragile materials limit possibilities as regards the possible shapes of external parts.

SUMMARY OF THE INVENTION

It is an object of the present invention to overcome all or part of the aforecited drawbacks by proposing an external part which is less limited in regard to shape yet still retains the possibility of using silicon or ceramic based portions.

Hence the invention relates to an external part including a first photostructurable glass based portion, at least a second portion based on at least a second material, characterized in that one surface of the first portion is made integral with a surface of the second portion so as to form a one-piece external part.

Advantageously according to the invention, it is understood that the external part is of the composite type, i.e. it is formed of photostructurable glass and of at least one other material. It is therefore understood that particular shapes can be obtained with the photostructurable glass portion while retaining a functional silicon, metal or ceramic based element.

In accordance with other advantageous variants of the invention:

said at least one second material is silicon-based and includes single crystal silicon, doped single crystal silicon, polycrystalline silicon, doped polycrystalline silicon, porous silicon, silicon oxide, quartz, silica, silicon nitride or silicon carbide;

said at least one second material is ceramic-based and includes photostructurable glass, borosilicate, aluminosilicate, quartz glass, zerodur, single crystal corundum, polycrystalline corundum, alumina, aluminium oxide, aluminium nitride, single crystal ruby, polycrystalline ruby, zirconium oxide, titanium oxide, titanium nitride, titanium carbide, tungsten nitride, tungsten carbide, boron nitride or boron carbide;

said at least one second material is metal-based and includes an iron alloy, a copper alloy, nickel or an alloy thereof, titanium or an alloy thereof, gold or an alloy thereof, silver or an alloy thereof, platinum or an alloy thereof, ruthenium or an alloy thereof, rhodium or an alloy thereof, or palladium or an alloy thereof;

said at least one second material further includes at least a partial coating of silicon oxide, silicon nitride, silicon carbide or an allotrope of carbon;

the first portion and/or the second portion forms a case, a case middle, a horn, a dial, a flange, a bezel, a push-button, a crown, a case back cover, a hand, a bracelet or wristlet, a link, a clasp, a decoration, an applique, a crystal, a dial-foot, a winding stem, a push-button arbor.

The invention relates to a timepiece, characterized in that it includes an external piece according to any of the preceding variants.

Further, according to a first embodiment, the invention relates to a method for manufacturing a one-piece external part including the following steps:

a) taking a first wafer based on photostructurable glass including a first etched pattern;

b) taking at least a second wafer made of at least a second material including at least a second etched pattern;

c) joining or bonding the first wafer with said at least one second wafer to form a substrate and, by superposition of said patterns, forming a one-piece external part including a first thickness based on photostructurable glass and at least one second thickness of said at least one second material;

d) releasing the external part from the substrate.

According to a second embodiment, the invention relates to a method for manufacturing a one-piece external part including the following steps:

e) joining or bonding a first wafer based on photostructurable glass with at least a second wafer made of at least a second material to form a substrate;

f) etching a pattern in each of the wafers of the substrate and, by superposition of said patterns, forming a one-piece external part including a first thickness based on photostructurable glass and at least one second thickness of said at least one second material;

d) releasing the one-piece external part from the substrate.

Finally, regardless of the embodiment, several external parts are made on the same substrate for the mass production thereof.

BRIEF DESCRIPTION OF THE DRAWINGS

Other features and advantages will appear clearly from the following description, given by way of non-limiting illustration, with reference to the annexed drawings, in which.

DETAILED DESCRIPTION OF PREFERRED EMBODIMENTS

Figure 1:
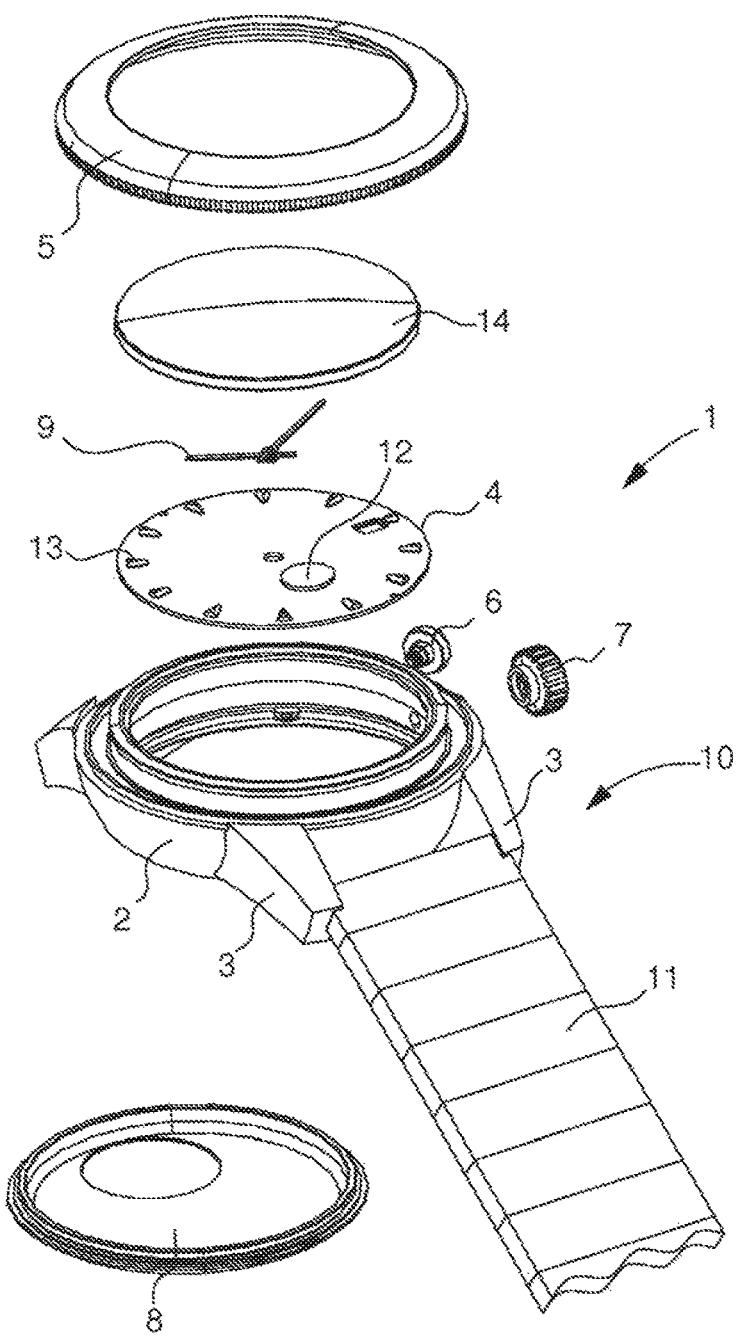
FIG. 1 is a perspective view of external parts according to the invention.

As explained above, the invention relates to an external part formed with the aid of a first portion based on photostructurable glass with a second portion including the same type of material or another type of material, i.e. for example based on silicon, metal or ceramic.

This external part was devised for applications in the field of horology and is made necessary by the structuration limitations of fragile materials such as silicon or ceramic based materials. It is possible, for example, to envisage forming a case, a dial, a flange, a crystal, a bezel, a push-button, a crown, a case back cover, a hand or a bracelet or wristlet completely or partially from fragile materials.

However, always having to use ordinary parts, such as, for example, corundum crystals, the production of which is mastered, is a constraint which is difficult to reconcile with the use of parts having no plastic domain.

Hence the invention relates to an external part including a first portion based on photostructurable glass, at least one second portion based on at least a second material, characterized in that one surface of the first portion is made integral with a surface of the second portion so as to form a one-piece external part.

Advantageously according to the invention, it is understood that the first portion will have greater possibilities in regard to shape while retaining a second portion that utilises the advantages of its material. Further, there is a large variety of possible bonding processes for photostructurable glass. Consequently, it is not essential to use additional material to make the two portions integral, as is the case with adhesive bonding or the use of an intermediate part. Thus, for example, two surfaces of corresponding shapes are sufficient to join or bond the first portion with the second portion.

As explained above, the one-piece external part may be completely or partially formed from a basis of photostructurable glass. Thus, said at least one second material may be based on silicon, metal or ceramic. Further, said at least one second material may also optionally include an intermediate material intended to promote the bonding of two materials that are difficult to attach. Thus, depending on the bonding technique selected, this intermediate material may be likened to a braze intended to attach two materials to each other by joint adherence to the intermediate material, or form a layer intended to produce sufficiently intense heat to cause the two materials to melt.

When said at least one second material is silicon-based, it may include single crystal silicon, doped single crystal silicon, polycrystalline silicon, doped polycrystalline silicon, porous silicon, silicon oxide, quartz, silica, silicon nitride or silicon carbide.

When said at least one second material is ceramic-based, it may include photostructurable glass, borosilicate, aluminosilicate, quartz glass, zerodur, single crystal corundum, polycrystalline corundum, alumina, aluminium oxide, aluminium nitride, single crystal ruby, polycrystalline ruby, zirconium oxide, titanium oxide, titanium nitride, titanium carbide, tungsten nitride, tungsten carbide, boron nitride or boron carbide.

When said at least one second material is metal-based, it may include an iron alloy like 15P, 20AP or 316L steels, a copper alloy such as brass, a nickel alloy such as nickel silver, titanium or an alloy thereof, gold or an alloy thereof, silver or an alloy thereof, platinum or an alloy thereof, ruthenium or an alloy thereof, rhodium or an alloy thereof, or palladium or an alloy thereof.

Further, said at least one second material, even based on silicon, metal or ceramic, may include at least a partial coating of silicon oxide, silicon nitride, silicon carbide or an allotrope of carbon.

Advantageously according to the invention, the first portion and/or the second portion may form a large variety of external parts for a timepiece. By way of non-limiting example and with reference to FIG. 1, the first portion and/or the second portion may therefore notably form a case 1, such as case middle 2 and horns 3, a dial 4, a flange, a bezel 5, a push-button 6, a crown 7, a case back cover 8, a hand 9, a bracelet or wristlet 10, such as a link 11, a decoration 12, an applique 13, a crystal 14, a clasp, a dial-foot, a winding stem or a push-button arbor.

Figure 2:
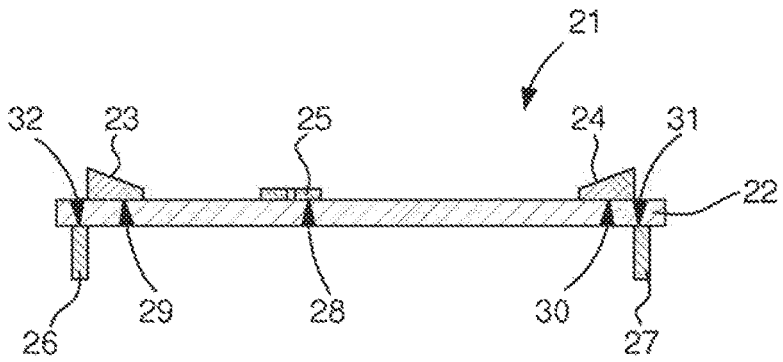
FIG. 2 is a cross-sectional view of an external part according to the invention.

By way of example, FIG. 2 shows an external part 21 forming a dial 22. The body of dial 22 includes several appliques 23, 24 forming, for example, an hour-circle, a decoration 25 representing, for example, a brand name, and several dial-feet 26, 27 for securing dial 22 to a timepiece.

It is understood therefore, for example, that dial 22 may be integral via its contact surfaces 28, 29, 30, 31, 32 with appliques 23, 24 and/or decoration 25 and/or feet 26 27, the photostructurable glass based portion being formed by dial 22 and/or appliques 23, 24 and/or decoration 25 and/or feet 26, 27. Of course, other types of contact surface may be provided, such as sloping surfaces or non-rectilinear surfaces.

As explained above, the first portion and/or the second portion may form a variety of external parts. By way of additional example in FIG. 2, case 1 could be formed from a first portion forming the case middle 2 and of several second portions forming the horns 3, or bracelet 10 could be formed from several first portions forming several links 11, each first portion being made integral with several second portions forming decorations.

Further, a first portion could form a crystal 14 and be integral with a second portion forming a bezel 5 or a magnifying glass, a first portion could form a push-button 6 and be integral with a second portion forming a push-button arbor, a first portion could form a crown 7 and be integral with a second portion forming a winding stem, a first portion could form a case back cover 8 and be integral with a second portion forming a crystal intended to show the timepiece movement, a first portion could form a bracelet attachment link and be integral with a second portion forming a clasp or a first portion could form a bracelet link 11 and be integral with a second portion forming a counter-link.

Figure 3:
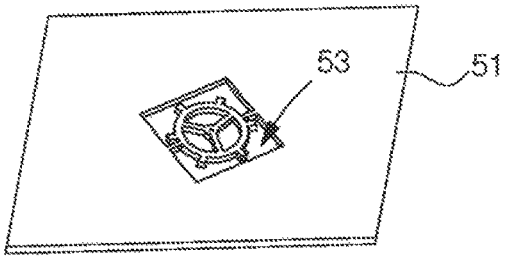
FIGS. 3 to 5 are views of steps of a method for manufacturing an external part according to the invention.

According to a first preferred embodiment, the invention relates to a manufacturing method including a first step a) intended to provide a first wafer 51 based on photostructurable glass including a first etched pattern 53 as shown in FIG. 3. Such glasses are, for example, available from Schott A. G. under the reference Foturan®, from Hoya Corp under the reference PEG3® or from LifeBioScience Inc. under the reference Apex™.

Advantageously according to the invention, photostructuration of a photostructurable glass allows for a greater variety of shape than etching of silicon or ceramic based materials. The photostructuration process consists, in a first phase, of illumination at a wavelength corresponding to photostructurable glass through a mask that is partially opaque to said wavelength. Areas of the photostructurable glass wafer are structured according to the quantity, orientation and distribution of illumination.

It is thus understood that by using a mask with areas of variable opacity and/or a source with controllable focus, it is possible to create shapes such as the aforementioned appliques 23, 24. The illumination source may for example by a UV lamp with a spectral distribution peak at a wavelength comprised between 200 and 400 nm.

A second phase consists in subjecting the photostructurable glass wafer to a heat treatment. The heating temperature varies according to the photostructurable glass and may be up to approximately 600° C. This heat treatment makes more selective illuminated areas for the last elimination phase by a chemical etching. This chemical etching may be performed, for example, in a 10% hydrofluoric acid bath, at ambient temperature and using ultrasounds. A wafer 51 as shown in FIG. 3 is thus obtained.

Figure 4:
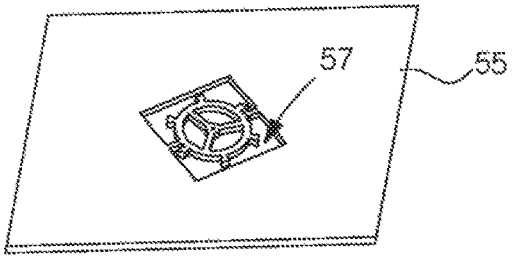

A second step b) is intended to provide at least a second wafer 55 made of at least a second material including at least a second etched pattern 57 as shown in FIG. 4. In a non-limiting manner, a dry etching such as a deep reactive ionic etching (DRIE), laser etching or a plasma etching may be mentioned. It is also perfectly possible to envisage using a wet etching, such as a chemical etching or even another photostructuration, as explained above. Finally, it is also possible to perform photostructuration mixing photolithography of a resin followed by a dry etching or wet etching.

A third step c) is intended to join or bond first wafer 51 with said at least one second wafer 55 to form a one-piece substrate and, by superposition of said patterns 53, 55, to form a one-piece external part including a first thickness based on photostructurable glass and at least a second thickness of said at least one second material based on silicon, metal or ceramic.

Depending on the materials used, there are several possible bonding methods. In a non-limiting manner, one may mention the direct welding of surfaces by electromagnetic radiation using a laser, as, for example, explained in EP Patent No 1436830, which is incorporated by reference in this description. It is also perfectly possible to envisage using anodic bonding, fusion bonding, thermocompression bonding, reflow bonding, eutectic bonding, ultrasonic bonding or thermosonic bonding.

Finally, the method includes a final step d) intended to release the one-piece external part from the substrate. Advantageously according to the invention, a large variety of materials can thus be used to form external parts in an industrial manner.

As illustrated in FIG. 2, it is possible, for example, to obtain dial 22 including a first thickness 22 based on photostructurable glass, and at least a second thickness 23, 24, 26, 27 of said at least second material.

According to an alternative of the first embodiment, step b) may consist in forming several second wafers formed from the same material or from several different materials. In this alternative of the first embodiment, it is therefore understood that in step c) it is possible to obtain a one-piece substrate with three bonded wafers thus forming an external part including a first thickness based on photostructurable glass forming the body of dial 22 and at least two second thicknesses formed from the same material or from several different materials forming the appliques 23, 24 and feet 26, 27 of the dial.

According to a second embodiment, the invention relates to a manufacturing method including a first step e) intended to join or bond a first photostructurable glass based wafer with at least a second wafer made of at least a second material to form a one-piece substrate with the aid of the same methods described in step c) of the first embodiment.

The second embodiment continues with step f), intended to etch a pattern in each of the wafers of the substrate and, by superposition of said patterns, to form a one-piece external part including a first thickness based on photostructurable glass and at least one second thickness of said at least one second material with the aid of the same methods described in steps a) and b) of the first embodiment.

Finally, the method includes a final step g) intended to release the one-piece external part from the substrate. Advantageously according to the invention, a large variety of materials can thus be used to form external parts in an industrial manner.

As illustrated in FIG. 2, it is possible, for example, to obtain dial 22 including a first thickness 22 based on photostructurable glass, and at least a second thickness 23, 24, 26, 27 of said at least second material.

According to an alternative of the second embodiment, similar to that of the first embodiment, step e) may also consist in making a substrate with the aid of several second wafers formed from the same material or from several different materials. In this alternative of the second embodiment, it is therefore understood that it is possible to obtain a substrate with three bonded wafers thus forming an external part including a first thickness based on photostructurable glass and at least two second thicknesses formed from the same material or from several different materials as for the first embodiment.

Figure 5:
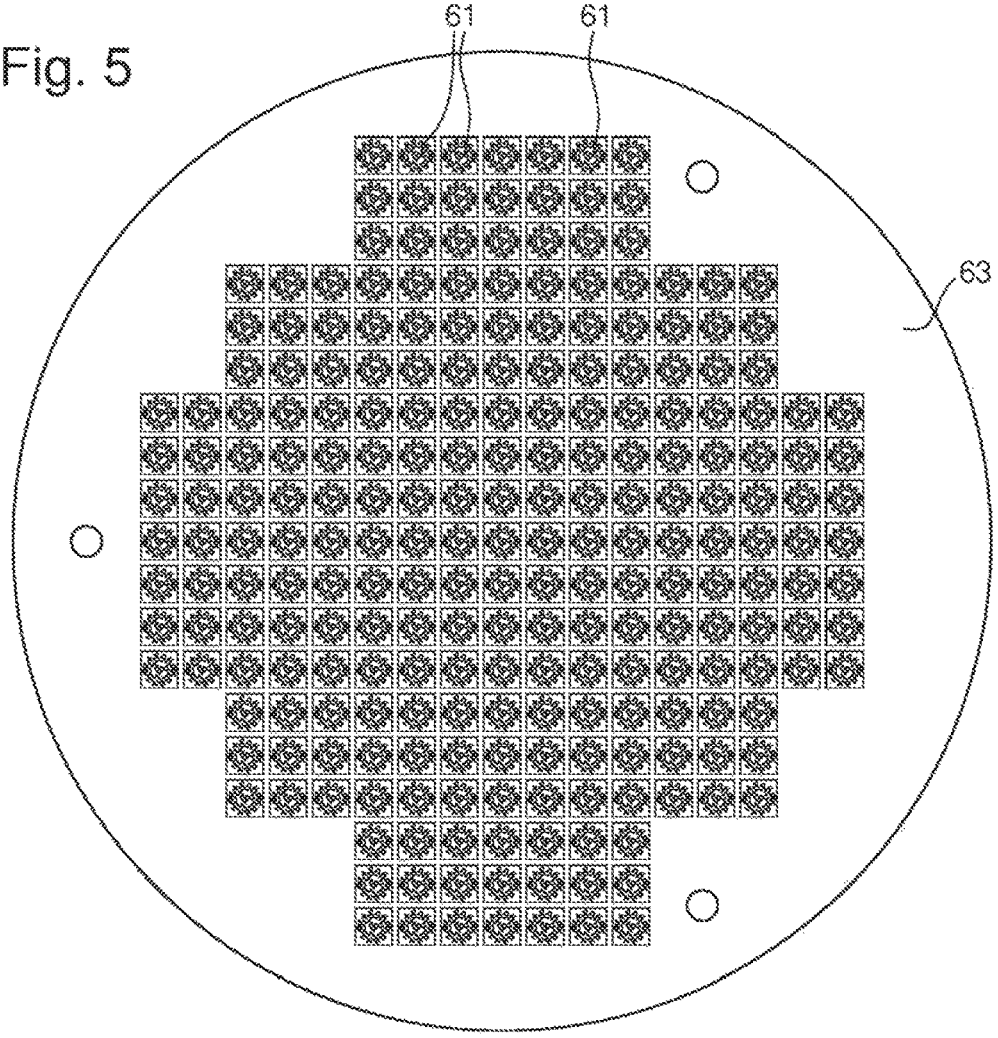

Of course, regardless of the embodiment, the method permits several external parts 61 to be manufactured on the same substrate 63 as illustrated in FIG. 5, The present invention is not limited to the illustrated example but is capable of various variants and modifications which will be clear to those skilled in the art. In particular, if the same pattern is required for each portion, the wafers may be bonded to each other and then a single etching may be provided.

Likewise, as in the example of the multiple appliques 13, 23, 24 of dial 4, 22, the method using wafers is preferred, i.e. all of appliques 13, 23, 24 are structured in the same photostructurable glass wafer and made integral with another wafer. However, there is nothing to prevent appliques 13, 23, 24 from being detached one-by-one and then gradually made integral with another finished part, such as dial 4, 22.

The invention claimed is:

1. A method of manufacturing a one-piece external part comprising the following steps:

a) taking a first wafer based on a photostructurable glass including a first etched pattern;

b) taking at least a second wafer made of at least one second material including at least a second etched pattern;

c) joining the first wafer with the at least one second wafer to form a substrate and, by superposition of patterns, forming the one-piece external part including a first thickness based on the photostructurable glass and at least one second thickness of the at least one second material; and d) releasing the one-piece external part from the substrate.

2. The method according to claim 1, wherein step b) includes taking a plurality of second wafers made of a same second material.

3. The method according to claim 1, wherein step b) includes taking a plurality of second wafers made of several different second materials.

4. The method according to claim 2, wherein step c) includes joining the first wafer with the plurality of second wafers to form a one-piece substrate.

5. The method according to claim 1 further comprising a step of photostructuration, the photostructuration step includes a first phase of illumination at a wavelength corresponding to the photostructurable glass through a mask partially opaque to said wavelength.

6. A method of manufacturing a one-piece external part comprising the following steps:

e) joining a first wafer based on a photostructurable glass with at least a second wafer made of at least one second material to form a substrate;

f) etching a pattern in each of the first and the second wafers of the substrate and, by superposition of patterns, forming the one-piece external part including a first thickness based on the photostructurable glass and at least one second thickness of the at least one second material; and g) releasing the one-piece external part from the substrate.

7. The method according to claim 6, wherein step e) includes making the substrate with a plurality of second wafers formed from a same second material.

8. The method according to claim 6, wherein step e) includes making the substrate with a plurality of second wafers formed from several different second materials.

9. The method according to claim 6 further comprising a step of photostructuration, the photostructuration step includes a first phase of illumination at a wavelength corresponding to the photostructurable glass through a mask partially opaque to said wavelength.

10. The method according to claim 9, wherein the photostructuration step includes a second phase subjecting a photostructurable glass wafer to a heat treatment.

* * * * *